United States Patent [19]

Reynolds

[11] Patent Number: 4,782,954

[45] Date of Patent: Nov. 8, 1988

[54] MENDING KIT

[76] Inventor: Jack M. Reynolds, 33 Rolling Green Cir., San Francisco, Calif. 94015

[21] Appl. No.: 61,750

[22] Filed: Jun. 11, 1987

[51] Int. Cl.[4] ..... B65D 81/36; B65D 85/24

[52] U.S. Cl. ..... 206/574; 206/227; 206/228; 223/109 R

[58] Field of Search ..... 206/63.3, 227, 380, 206/382, 383, 574, 228; 223/108, 109 R, 109 A

[56] References Cited

U.S. PATENT DOCUMENTS

| | | | |
|---|---|---|---|
| 1,298,501 | 3/1919 | Hawkes | 223/109 R |
| 1,819,862 | 8/1931 | Bergstedt | 223/109 R |
| 2,037,628 | 4/1936 | Hogarth . | |
| 2,109,318 | 2/1938 | Lichter | 206/227 |
| 2,144,199 | 1/1939 | Press | 223/109 R |
| 2,475,324 | 7/1949 | Jaske | 7/14.5 |
| 2,600,589 | 6/1952 | Swanson . | |
| 2,642,211 | 6/1953 | Yingling | 223/109 |
| 2,667,009 | 1/1954 | Bear | 206/227 |
| 3,180,487 | 4/1965 | Uddenborg | 206/380 |
| 3,283,976 | 11/1966 | Snyder | 223/109 R |
| 3,357,550 | 12/1967 | Holmes et al. | 206/63.3 |
| 4,032,012 | 6/1977 | Bishop . | |
| 4,135,622 | 1/1979 | Glick | 206/63.3 |
| 4,135,623 | 1/1979 | Thyen . | |
| 4,391,365 | 7/1983 | Batchelor . | |

FOREIGN PATENT DOCUMENTS

| | | | |
|---|---|---|---|
| 1532395 | 7/1968 | France | 223/108 |

*Primary Examiner*—Jimmy G. Foster

*Attorney, Agent, or Firm*—Townsend and Townsend

[57] ABSTRACT

A mending kit consisting of individual thread and needle units having prethreaded needles. Each thread and needle unit includes a needle prethreaded with a predetermined length of thread packaged on a card-like housing. The housing includes a seat for the needle which at least partially surrounds the needle to define its position on the housing. The length of thread is wrapped around a spool section of the housing, also assisting in retaining the needle in position on the housing. A thread cutter is provided for the convenience of the user on the housing. Retaining slits on the housing secure the free ends of the length of thread.

8 Claims, 1 Drawing Sheet

MENDING KIT

BACKGROUND OF THE INVENTION

This invention relates to mending kits for sewing fabric, and more specifically, mending kits containing needles and thread.

It is often convenient to have portable mending kits available to make minor repairs in garments. Small mending kits are convenient when a person is away from home and does not have access to sewing supplies. Sewing kits have been offered to guests at many of the hotels and inns as a convenience to their guests. Larger sewing kits having a variety of threads and needles are useful for households or offices.

As luck would have it, clothing catastrophes often occur when the wearer is in a rush. When a button pops off, or a hem is suddenly ripped out, the wearer is usually desperate to have it mended as soon as possible. It is at times like these that the elaborate and painstaking task of threading a needle becomes most formidable.

The most difficult step in most fabric repair tasks is the initial threading of the needle. Unless one is an experienced seamstress or tailor, coaxing a thread, especially one having multiple plies which have a tendency to fray, through the slender eye of the needle is quite a challenge. For persons with impaired eyesight, fine motor coordination problems, or simply little patience, threading a needle is a frustrating task. A prethreaded needle and thread in a mending kit which provides a selection of thread colors and weights, and which is relatively simple and inexpensive to manufacture is desirable.

SUMMARY OF THE INVENTION

In accordance with the present invention, a mending kit is provided which includes individual needle and thread units. Each needle and thread unit is made up of a needle prethreaded with a length of thread suitable for sewing fabric and seated on a housing. The seat on the housing at least partly encloses the point end of the needle. The length of thread is wrapped around a spool section of the housing. A plurality of such needle and thread units are provided in an assortment of colors for convenience and portability.

The needle and thread units provide individually packaged, self-contained units. The seat on the housing for the needle at least partly encloses the needle to assure that it remains in place. The spool sections are provided to wind the lengths of thread around to prevent the lengths of thread from becoming tangled while stored, and to provide for easy selection and handling when a needle and thread is needed. A thread cutter is provided along the housing for convenience of the user. Thus, the person performing the repair need only choose the color needed, unwind the thread, and make the repair.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
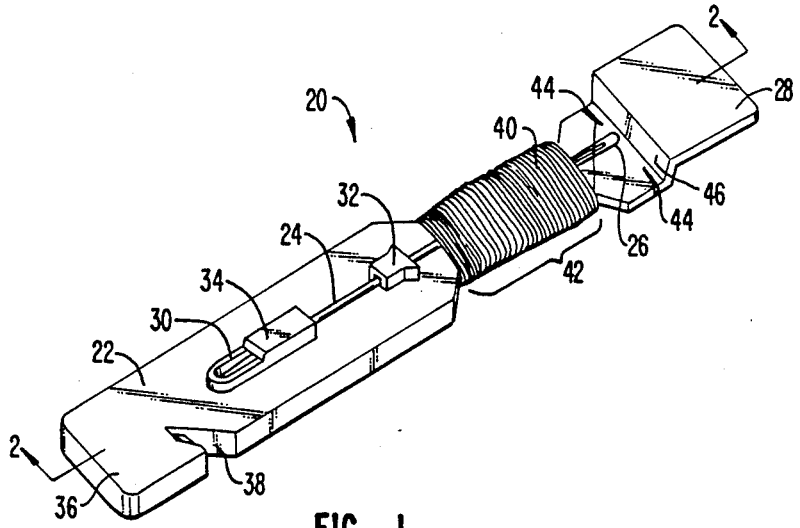
FIG. 1 is an isometric view of a single needle and thread unit for the mending kit.

It is understood that the individual needle and thread units 20 are easily adapted in size and dimension to be utilized for any weight of thread and size of needle. For the conventional needle and thread used for most repairs, as shown in FIG. 1, housing 22, generally a planar card, is approximately ½ inch wide (13 mm) and 2½ inches long (62 mm).

The needle 24 is removably and longitudinally seated in a partially enclosed seat position on the upper surface of housing 22 where its eye end 26 is proximate a first end 28 of housing 22 and its point end 30 is threaded through a guide 32 and into a point protector 34. The point end 30 is proximate a second end 36 of housing 22 adjacent which a cutting slot 38 is provided.

Needle 24 is threaded as a part of the assembly process for each individual needle and thread unit 20. The thread length 40 may be doubled and knotted at the ends or may be a single strand with a single knotted end. In assembling each needle and thread unit 20, the needle 24 is first threaded with thread length 40 and placed on housing 22 through guide 32 and point protector 34. Thread length 40 is then wrapped about a spool section 42 of housing 22. In its assembled condition, the thread wrapped around spool section 42 of housing 22 assists in retaining the needle in its seat on housing 22. The free end or ends 45 of thread length 40 are then passed through one of the retainer slits 44 provided near first end 28 for the purpose of neatly securing the thread length ends. In this way, the thread remains wrapped around spool section 42 and can easily be found when needed by a user.

In the preferred embodiment, the eye end 26 of the needle abuts a slight flange 46 provided adjacent first end 28 of housing 22 so that the needle 24 is not accidentally dislodged longitudinally from housing 22. The point protector 34 covers the point end of the needle to prevent it from inadvertently stabbing the user and catching other lengths of thread on adjacent thread and needle units.

Figure 2:
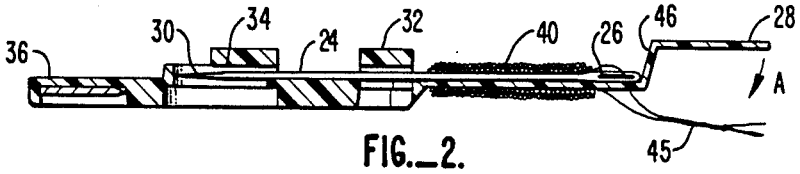
FIG. 2 is an edge view of a needle and thread unit for the mending kit.
Figure 3:
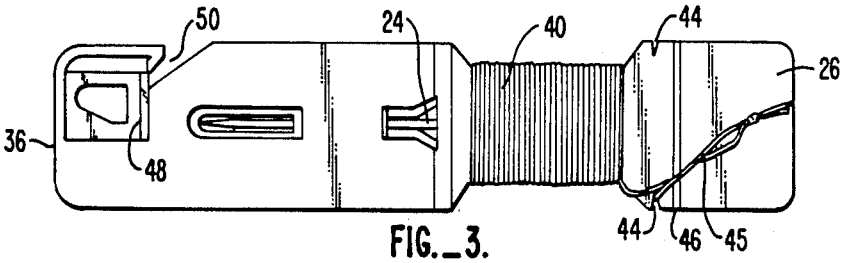
FIG. 3 is a plan view of the underside of a needle and thread unit for the mending kit.

The structure of housing 22 is further illustrated in FIGS. 2 and 3. Housing 22 may be cut, formed or injection molded from any suitably rigid yet flexible planar material. Depending on the material of construction, the housings can be intended to be disposable, or refillable. The embodiment illustrated herein is molded from a moldable thermoplastic which is relatively inexpensive. The housing 22 is unitary, with only a cutting blade 48 which is separately mounted to the underside of housing 22 as shown in FIG. 3.

To use the thread and needle unit, the user need only grasp and remove thread end 45 from its retainer slit 44. After thread length 40 is unwound from spool section 42, needle 24 can be removed by bending end 28 of housing 22 in the direction indicated by arrow A in FIG. 2. This bending exposes eye end 26 of needle 24 so that it can be slid out of guide 32 and point protector 34. If the housing is constructed from inflexible material, the needle may be removed by simply inverting housing 22 so that the needle 24 falls out. The needle and thread are then used in a conventional fashion for the mending task. When the sewing task is completed, there is no need to locate a pair of scissors to cut the thread, since a thread cutter 54 is conveniently provided on each housing 22.

Figure 5:
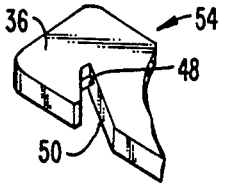
FIG. 5 is a detail view of the thread cutter of an individual unit.

The thread cutter 54 is shown in detail in FIG. 5, with the sharp edge of the blade overlapping slot 52 of housing 22 so that it projects slightly to provide a cutting surface within the confines of slot 52. To use thread cutter 54, the user holds the thread taut and passes it through slot 52 so that it is cut along the edge of blade 48.

Figure 4:
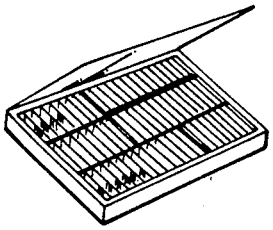
FIG. 4 is an isometric view of a box containing an assortment of needle and thread units.

Each individual thread and needle unit 20 is provided with a single thread length 40 of a particular color or type of thread. It is desirable to provide a variety of thread and needle units 20 carrying different colored threads and different weights of threads for whatever need might arise. FIG. 4 illustrates one packaging configuration for multiple thread and needle units. Small sets of thread and needle units in basic colors might be provided as portable mending kits, while larger sets with a larger assortment and selection of colors and thread weights would be more suitable as mending kits for use at home or in the workplace.

The foregoing is a complete description of the invention, but is not intended to limit the scope of the invention, except as stated in the appended claims. While the above provides a full and complete disclosure of the preferred embodiment of the invention, various modifications, alternate constructions, and equivalents may be employed without departing from the true spirit and scope of the invention. For example, the embodiment described herein and shown in the drawings discloses a thread and needle unit for a single needle and thread. It is also contemplated that a single housing 22 could be elongated to seat two needles longitudinally aligned. In this way, a single thread cutter could serve two needle and thread combinations, which would reduce fabrication costs. Other shapes of housings are conceivable which would seat three or more needle and thread combinations. Therefore, the above description and illustrations should not be construed as limiting the scope of the invention which is defined by the following claims.

What is claimed is:

1. A mending kit comprising:

a needle having a length, an eye at a first end and a point at a second end;

an elongated housing, made of a relatively stiff plastic material, having an upper surface, a first end and a second end, which housing includes:

a needle-receiving seat section, adapted to receive said needle, generally longitudinally disposed along said upper surface, said seat section including:

a horizontally disposed needle guide/point protector, adapted to receive and protect said pointed second end of said needle; and resilient means, movable from a normal, blocking position to a deflected, non-blocking position, for blocking inadvertent longitudinal movement of said needle, said blocking means located at and extending away from said upper surface generally near said first housing end, said blocking means opposite and axially aligned with said eye when said blocking means is in the blocking position to prevent removal of said needle from said needle guide/point protector, said blocking means spaced apart from said eye, permitting longitudinal movement of said needle from said needle guide/point protector, when said blocking means is in the non-blocking position; and a spool section between said needle guide/point protector and said resilient blocking means; and a length of thread, having a first end and a second end, wrapped about said needle and said spool section of said housing;

whereby said needle and thread are visible with said needle point protected by said needle guide/point protector.

2. The mending kit of claim 1, wherein said needle guide/point protector includes a point protector, for housing the needle point, and a tunnel-shaped guide, spaced apart from the point protector, adapted to guide said needle point into said point protector.

3. The mending kit of claim 1, wherein said resilient means for blocking includes a movable flange formed integrally with said housing, which flange has a blocking surface that abuts said needle eye when in the blocking position and is spaced apart from said needle eye when in the non-blocking position.

4. The mending kit of claim 1, wherein said spool section is at a narrowed portion of said housing.

5. The mending kit of claim 1, wherein said needle is prethreaded with said length of thread.

6. The mending kit of claim 1, further including a thread cutter mounted on said housing, adapted to cut said thread.

7. The mending kit of claim 1, wherein said housing includes a retaining slit, adapted to retain said thread when cut.

8. The mending kit of claim 1, including a plurality of said needles, elongated housings and lengths of threads.

* * * * *